US010497209B2

(12) United States Patent
Macdonald

(10) Patent No.: US 10,497,209 B2
(45) Date of Patent: Dec. 3, 2019

(54) INVESTOR CONTROLLED RISK MATRIX

(71) Applicant: Bruce Anthony Macdonald, Oceanside, CA (US)

(72) Inventor: Bruce Anthony Macdonald, Oceanside, CA (US)

(73) Assignee: Bruce A. Macdonald, Oceanside, CA (US)

( * ) Notice: Subject to any disclaimer, the term of this patent is extended or adjusted under 35 U.S.C. 154(b) by 0 days.

(21) Appl. No.: 15/971,167

(22) Filed: May 4, 2018

(65) Prior Publication Data

US 2018/0322734 A1 Nov. 8, 2018

Related U.S. Application Data

(63) Continuation-in-part of application No. 15/585,446, filed on May 3, 2017.

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3237* (2013.01); *G07F 17/322* (2013.01); *G07F 17/3213* (2013.01); *G07F 17/3288* (2013.01)

(58) Field of Classification Search

CPC .... G07F 17/32; G07F 17/3213; G07F 17/322; G07F 17/3237; G07F 17/3288; G07F 17/329; G06Q 40/06; G06F 7/588

See application file for complete search history.

(56) References Cited

U.S. PATENT DOCUMENTS

| | | | | |
|---|---|---|---|---|
| 8,540,568 | B2 * | 9/2013 | Frick | G06F 17/00 463/17 |
| 2010/0062821 | A1 * | 3/2010 | Frick | G07F 17/32 463/17 |
| 2010/0062823 | A1 * | 3/2010 | Frick | G07F 17/32 463/17 |
| 2010/0062824 | A1 * | 3/2010 | Frick | G07F 17/32 463/17 |
| 2010/0062825 | A1 * | 3/2010 | Frick | A63F 3/081 463/17 |
| 2012/0299241 | A1 * | 11/2012 | Frick | A63F 3/081 273/139 |

* cited by examiner

*Primary Examiner* — Milap Shah

(57) ABSTRACT

A system and method for user created 2-dimensional risk classes and levels is described. In one embodiment, this matrix allows the user to create and select risk thresholds for the placement of bets that from an investment perspective can lead to the construction of a new type of financial instrument similar to low yield, low risk government issued bonds. In a second embodiment this is a zero-consideration contest where users compete at no cost for prizes to be awarded. In a third embodiment (and where it is legal to do so), this is a gambling application. The risk matrix is created and managed by the user and no one else. Included are computer runs that highlight important aspects of the invention. Finally, a tangible new game embodiment is described that replaces a standard Roulette table surface and wheel with new embodiments that implement the 2-dimensional risk classes described herein.

2 Claims, 10 Drawing Sheets

Player sequence diagram

| 1 | 2 | Winning Probability |
|---|---|---|
| 1.0 | 1.0 | 100.0% |
| 0 | 2.0 | 50.0% |

Figure 1: 2x2 Matrix

| 1 | 2 | 3 | Winning Probability |
|---|---|---|---|
| 1.0 | 1.0 | 1.0 | 100.0% |
| 0 | 1.5 | 1.5 | 66.66% |
| 0 | 0 | 3.0 | 33.33% |

Figure 2: 3x3 Matrix

| 1 | 2 | 3 | 4 | Winning Probability |
|---|---|---|---|---|
| 1.0 | 1.0 | 1.0 | 1.0 | 100.0% |
| 0 | 1.33 | 1.33 | 1.33 | 75.0% |
| 0 | 0 | 2.0 | 2.0 | 50.0% |
| 0 | 0 | 0 | 4.0 | 25.0% |

Figure 3: 4x4 Matrix

| 1 | 2 | 3 | 4 | 5 | Winning Probability |
|---|---|---|---|---|---|
| 1.0 | 1.0 | 1.0 | 1.0 | 1.0 | 100.0% |
| 0 | 1.25 | 1.25 | 1.25 | 1.25 | 80.0% |
| 0 | 0 | 1.66 | 1.66 | 1.66 | 60.0% |
| 0 | 0 | 0 | 2.5 | 2.5 | 40.0% |
| 0 | 0 | 0 | 0 | 5.0 | 20.0% |

Figure 4: 5x5 Matrix

| 1 | 2 | 3 | 4 | 5 | 6 | 7 | 8 | 9 | 10 | Winning Probability |
|---|---|---|---|---|---|---|---|---|---|---|
| 1.0 | 1.0 | 1.0 | 1.0 | 1.0 | 1.0 | 1.0 | 1.0 | 1.0 | 1.0 | 100.0% |
| 0 | 1.11 | 1.11 | 1.11 | 1.11 | 1.11 | 1.11 | 1.11 | 1.11 | 1.11 | 90.0% |
| 0 | 0 | 1.25 | 1.25 | 1.25 | 1.25 | 1.25 | 1.25 | 1.25 | 1.25 | 80.0% |
| 0 | 0 | 0 | 1.42 | 1.42 | 1.42 | 1.42 | 1.42 | 1.42 | 1.42 | 70.0% |
| 0 | 0 | 0 | 0 | 1.66 | 1.66 | 1.66 | 1.66 | 1.66 | 1.66 | 60.0% |
| 0 | 0 | 0 | 0 | 0 | 2.0 | 2.0 | 2.0 | 2.0 | 2.0 | 50.0% |
| 0 | 0 | 0 | 0 | 0 | 0 | 2.5 | 2.5 | 2.5 | 2.5 | 40.0% |
| 0 | 0 | 0 | 0 | 0 | 0 | 0 | 3.33 | 3.33 | 3.33 | 30.0% |
| 0 | 0 | 0 | 0 | 0 | 0 | 0 | 0 | 5.0 | 5.0 | 20.0% |
| 0 | 0 | 0 | 0 | 0 | 0 | 0 | 0 | 0 | 10.0 | 10.0% |

Figure 5: 10x10 Matrix

| 1 | 2 | 3 | 4 | 5 | 6 | 7 | 8 | 9 | 10 | Winning Probability |
|---|---|---|---|---|---|---|---|---|---|---|
| 1.0 | 1.0 | 1.0 | 1.0 | 1.0 | 1.0 | 1.0 | 1.0 | 1.0 | 1.0 | 100.0% |
| 0 | 1.11 | 1.11 | 1.11 | 1.11 | 1.11 | 1.11 | 1.11 | 1.11 | 1.11 | 90.0% |

Figure 6A

| 1 | 2 | 3 | 4 | 5 | 6 | 7 | 8 | 9 | 10 | Winning Probability |
|---|---|---|---|---|---|---|---|---|---|---|
| 1.0 | 1.0 | 1.0 | 1.0 | 1.0 | 1.0 | 1.0 | 1.0 | 1.0 | 1.0 | 100.0% |
| 0 | 1.11 | 1.11 | 1.11 | 1.11 | 1.11 | 1.11 | 1.11 | 1.11 | 1.11 | 90.0% |
| 0 | 0 | 1.25 | 1.25 | 1.25 | 1.25 | 1.25 | 1.25 | 1.25 | 1.25 | 80.0% |

Figure 6B

| 1 | 2 | 3 | 4 | 5 | 6 | 7 | 8 | 9 | 10 | Winning Probability |
|---|---|---|---|---|---|---|---|---|---|---|
| 1.0 | 1.0 | 1.0 | 1.0 | 1.0 | 1.0 | 1.0 | 1.0 | 1.0 | 1.0 | 100.0% |
| 0 | 1.11 | 1.11 | 1.11 | 1.11 | 1.11 | 1.11 | 1.11 | 1.11 | 1.11 | 90.0% |
| 0 | 0 | 1.25 | 1.25 | 1.25 | 1.25 | 1.25 | 1.25 | 1.25 | 1.25 | 80.0% |
| 0 | 0 | 0 | 1.42 | 1.42 | 1.42 | 1.42 | 1.42 | 1.42 | 1.42 | 70.0% |

Figure 6C

| 1 | 2 | 3 | 4 | 5 | 6 | 7 | 8 | 9 | 10 | Winning Probability |
|---|---|---|---|---|---|---|---|---|---|---|
| 1.0 | 1.0 | 1.0 | 1.0 | 1.0 | 1.0 | 1.0 | 1.0 | 1.0 | 1.0 | 100.0% |
| 0 | 1.11 | 1.11 | 1.11 | 1.11 | 1.11 | 1.11 | 1.11 | 1.11 | 1.11 | 90.0% |
| 0 | 0 | 1.25 | 1.25 | 1.25 | 1.25 | 1.25 | 1.25 | 1.25 | 1.25 | 80.0% |
| 0 | 0 | 0 | 1.42 | 1.42 | 1.42 | 1.42 | 1.42 | 1.42 | 1.42 | 70.0% |
| 0 | 0 | 0 | 0 | 1.66 | 1.66 | 1.66 | 1.66 | 1.66 | 1.66 | 60.0% |
| 0 | 0 | 0 | 0 | 0 | 2.0 | 2.0 | 2.0 | 2.0 | 2.0 | 50.0% |
| 0 | 0 | 0 | 0 | 0 | 0 | 2.5 | 2.5 | 2.5 | 2.5 | 40.0% |
| 0 | 0 | 0 | 0 | 0 | 0 | 0 | 3.33 | 3.33 | 3.33 | 30.0% |
| 0 | 0 | 0 | 0 | 0 | 0 | 0 | 0 | 5.0 | 5.0 | 20.0% |
| 0 | 0 | 0 | 0 | 0 | 0 | 0 | 0 | 0 | 10.0 | 10.0% |

Figure 6D

Player sequence diagram

Profit/Loss Graph for three different Risk Levels within three different Risk Classes (n X n matrix @ %)

Higher winning % translates to flatter curves.

New roulette table

User selects 25% from matrix – Dark band wins – White band loses.

New roulette table

User selects 50% from matrix – Dark band wins – White band loses.

New roulette table

User selects 75% from matrix – Dark band wins – White band loses.

INVESTOR CONTROLLED RISK MATRIX

RELATED APPLICATION DATA

This application claims the benefit of U.S. Provisional Application No. 62/452,836, filed Jan. 31, 2017.

OTHER REFERENCES CITED (OTHER PUBLICATIONS)

1. *Champion and Rose's Gaming Law in a Nutshell*
2. Potenza, 2008
3. Guryan & Kearney, 2010
4. Grusser, Plontzke, Albrecht, & Morsen, 2007
5. Parke & Griffiths, 2004
6. Moran 1997
7. Public Integrity, Fall 2006, vol. 8, no. 4, pp. 367-379

FIELD OF THE INVENTION

The present invention in general relates to a new type of Financial Instrument that merges aspects of traditional casino gambling with traditional Wall Street Financial Services.

The invention is an Investor controlled and self-regulating software framework that allows investors to create and select levels of risk and reward for their Investments.

The definition of "gambling," unless changed by statute, consists of any activity with three elements: consideration, chance, and prize. If any one or more of these elements is missing, the activity is not gambling (Champion and Rose's Gaming Law in a Nutshell).

The invention allows the Investor to create and manage their risk exposure (chance) to any arbitrary numerical precision between 0% and 100%.

BACKGROUND OF THE INVENTION

There is no admission that the background art disclosed in this section legally constitutes prior art.

There have been many systems and methods to enable users to submit bets via a betting matrix comprising a plurality of rows and columns. Many of these games are known as lottery games. The known lottery games have many different parameters which are often created to provide a more interesting playing experience and award more interesting prizes.

There are other related games that provide a player various choices within a matrix for playing the game. One such game is roulette. Roulette is a casino game where players may choose to place bets on parameters such as a single number or range of numbers, the colors red or black, or whether the number is odd or even. To determine the winning number and color, a croupier spins a wheel in one direction, then spins a ball in the opposite direction around a tilted circular track running around the circumference of the wheel. The ball eventually loses momentum and falls onto the wheel and into one of 37 (in French/European roulette) or 38 (in American roulette) colored and numbered pockets on the wheel.

The payout (except for the special case of "top line bets"), for American and European roulette, can be calculated by the formula: $\text{Payout}=(1/n)(36-n)=36/n-1$, where n is the number of squares the player is betting on. The initial bet is returned in addition to the mentioned payout. If the roulette game only had 36 numbers, this payout formula to the player would lead to a zero expected value of profit. However, because the wheel has either 37 or 38 numbers, the casino has the edge (profit).

In roulette, however, the game can be played with a single player, or many players, but the odds of the prizes do not change. A player cannot change the odds or payout of a standard roulette game, nor can a player necessarily choose how many players are in that same game.

In California, to play Super Lotto Plus the player chooses five numbers from 1 to 47 and one additional number from 1 to 27. The odds of correctly choosing all 6 numbers and winning the grand jackpot is 1 in 41,416,353, which is mathematically equivalent to guessing a single number out of 41,416,353 possibilities.

Further, gambling addiction is a public health problem. It has been estimated that approximately 5% of all adults have symptoms of problem gambling (Potenza, 2008). Neural states measured in problem gamblers have been compared to neural states invoked in cocaine dependence. Specifically, problem gamblers experience problems with impulsivity in making healthy gambling decisions. Lottery gambling in particular has been shown to have purchase patterns consistent with addiction (Guryan & Kearney, 2010). In fact, research has shown that up to 15% of lottery players have symptoms of problem gambling (Grusser, Plontzke, Albrecht, & Morsen, 2007).

A key component of gambling addiction is the concept of a "near miss". This cognitive mechanism occurs when a gambler feels that they can win a given gambling game if they only keep playing, regardless of previous failures (Parke & Griffiths, 2004). The existence of this mechanism in lottery purchases is clear: when a gambler sees evidence of successful lottery winners, this gives the gambler increased motivation to continue spending money on lottery tickets, even if the total amount spent is unhealthy (i.e. effecting the gambler's life in a negative way). Gambling products that give gamblers actual wins in much smaller monetary amounts than state lotteries may help reduce unhealthy gambling behavior influenced by "near misses".

A late-1980s Duke University study found that the poorest ⅓ of households bought more than ½ of all weekly lottery tickets sold (Moran 1997) (Public Integrity, Fall 2006, vol. 8, no. 4, pp. 367-379)

Therefore, what is needed for the good of the General Public is a mathematical construct implemented in software for use over the Internet that provides all players with an ability to create and manage their odds of winning.

Our invention gives participants actual wins in small, sustainable amounts with the option to select healthy amounts of risk. The invention generates all risk levels at draw time, however these risk levels are a function of the number of Investors participating in the event and as such the Investors know the risk levels ahead of time for that Investor pool size. Investors can create and select acceptable amounts of risk in a game. For example, they could select a 90% probability of payout (with lower payout for lower risk). The invention could be used to wean problem gamblers off high-risk games that invoke "near miss" cognitive mechanisms and subsequent problem gambling symptoms.

Because gambling addiction is a public health problem, supplemental forms of controlled, frugal gambling are needed that may help reduce gambling addiction.

BRIEF DESCRIPTION OF THE DRAWINGS

In order to better understand the invention and to see how the same may be carried out in practice, non-limiting preferred embodiments of the invention will now be described with reference to the accompanying drawings, in which:

FIG. 1 is an example 2×2 player game matrix (Risk Class 2) which is constructed in accordance with an embodiment;

FIG. 2 is an example 3×3 player game matrix (Risk Class 3) which is constructed in accordance with an embodiment;

FIG. 3 is an example 4×4 player game matrix (Risk Class 4) which is constructed in accordance with an embodiment;

FIG. 4 is an example 5×5 player game matrix (Risk Class 5) which is constructed in accordance with an embodiment;

FIG. 5 is an example 10×10 player game matrix (Risk Class 10) which is constructed in accordance with an embodiment;

FIGS. 6A-6D are partial matrices that demonstrate the process to create the example 10×10 matrix shown in FIG. 5;

DETAILED DESCRIPTION OF CERTAIN EMBODIMENTS OF THE INVENTION

Figure 7:
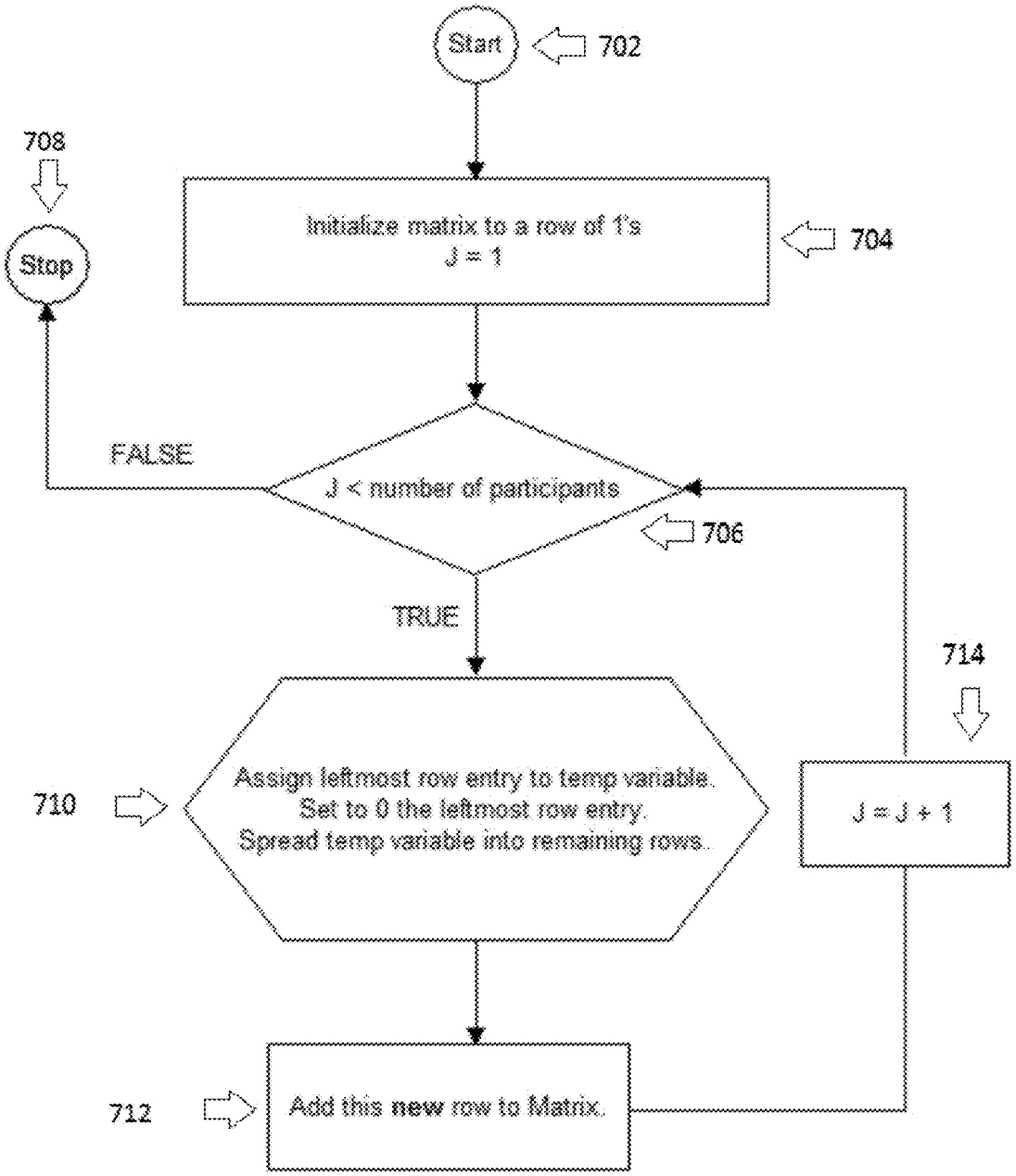
FIG. 7 shows a flowchart depicting the creation of a lottery game in accordance with an embodiment.

Certain embodiments of the present invention will now be described more fully hereinafter with reference to the accompanying drawings, in which some, but not all, embodiments of the invention are shown. Indeed, these embodiments of the invention may be in many different forms and thus the invention should not be construed as limited to the embodiments set forth herein; rather, these embodiments are provided as illustrative examples only so that this disclosure will satisfy applicable legal requirements. Like numbers refer to like elements throughout.

It will be readily understood that the components of the embodiments as generally described and illustrated in the drawings herein, could be arranged and designed in a wide variety of different configurations. Thus, the following more detailed description of the certain ones of the embodiments of the system, components and method of the present invention, as represented in the drawings, is not intended to limit the scope of the invention, as claimed, but is merely representative of the embodiment of the invention.

Investment matrix games that provide a player with an option to choose how many players that they are playing against, and to create and choose their odds of winning and resulting payout are disclosed. The game allows a player to create and choose the amount of risk they are willing to accept as the risk varies proportionally with the payout. Generally, a player may choose a particular game and risk/reward factor from a game provider that varies depending upon how many other players are choosing the same game. The games are shown to the player as different matrices, which depend upon the number of players. Players use the information such as the number of players to force expected ROI on investments. If the player does not get its expected threshold of success by not enough other players choosing the same lottery matrix game, then nothing is done with the player's money and it is returned. Game providers deduct service fees from the winning payout of each game. The game provider may compete with other game providers based on amount of these service fees.

In an embodiment, the game provider may be an online gambling website. The invention may be implemented as a peer to peer cloud-based lottery matrix game specifically for the blockchain. In another embodiment, the invention may be implemented as a peer to peer cloud-based financial services/investment instrument for the emerging cryptocurrency market also for the blockchain.

In another embodiment, the game may have 'Zero Consideration' and as such does not satisfy the definition of gambling. Prizes would be awarded to winners. Data mining would occur to analyze the run-time behavior of participants. An analysis of this data would then suggest recommendations for selling goods and services to these same participants.

In various embodiments, participants can choose to be either players or game providers. Further, the players or game providers may share in profits and/or losses. In an embodiment, a group of players may aggregate to form collective game providers and share in any profit/loss incurred in the execution on the lottery game.

In another embodiment, the invention may comprise an investment system. Generally, an Investor may choose an investment matrix (and associated risk/reward factor) from a producer (e.g., a bank) that has varying payouts depending upon how many other investors are choosing the same investment matrix. These matrices are different matrices depending upon the number of investors. In an embodiment, the investment system may be implemented as a peer to peer cloud-based financial services/investment instrument for the emerging cryptocurrency market, specifically for the blockchain. Investors may choose a particular investment matrix to provide an expected ROI on investments. If not enough other investors choose the same investment matrix, then the investor's money is returned. Banks may deduct service fees from the winning investment payout of each matrix. The banks may compete with each other based on amount of the service fees.

The invention allows players to create and control win/loss game probabilities, start times and the maximum amount of payout (money) that can be won in any given game. These three factors fundamentally shift control of the monetization aspects of a conventional lottery game from the game provider to the player.

More specifically, the invention gives a player the ability to create and select win/loss probabilities for any game. There are no assigned win/loss probabilities prior to playing of the game. The invention generates all probabilities at draw time based on several factors. In various embodiments, the lottery game provides a random number generation such as from a software system or a physical apparatus of floating balls.

One game probability factor is a function of the number of players participating in the draw as shown by the equation:

$$P(G)=f(n)$$

where "P" denotes probability of winning,

"G" denotes the particular game, and

"n" is the number of players in the draw.

This is unlike conventional lottery games that have pre-set win/loss probabilities which are calculated and known prior to any draw. In the conventional games, the probabilities are created by the house (game provider) and without any input from the players.

Further, the maximum amount of money that can be won in any game is a function of the number of players in the game, and is controlled by each player and not the house. As an example of a game a player bets one token. In the example, one token may represent one (1) US dollar. The maximum payout if directly related to the number of players. For example, where 100 people are playing the game, the maximum payout amount anyone can win is 100 tokens.

In an embodiment, the currency may be exchanged into Bitcoin or another cryptocurrency of the player's choice prior to the start of the game. The invention may employ cryptocurrency which may be coded on a blockchain-style architecture.

Referring now to the drawings, FIGS. 1-5 show exemplary game matrices of the lottery of the present invention. These matrices show the user-created probability matrix that drives player bet decisions.

FIG. 1 shows an example 2×2 player game matrix which is constructed in accordance with an embodiment. This is the simplest game possible using the matrices. This is because if only one player was playing the game, the payout would always be 100%. In order to play, a player selects a row that represents the probability that the player desires for the next game. If two players are playing as shown in the 2×2 matrix, the winning probability is either 100% (first playing row) or 50% (second playing row).

FIG. 2 is an example 3×3 player game matrix which is constructed in accordance with an embodiment. This game is similar to the 2×2 matrix game but that there are now three choices of probability of winning for the players including 100% (first playing row), 66.67% (second playing row) or 33.33% (third playing row).

FIG. 3 is an example 4×4 player game matrix which is constructed in accordance with an embodiment. In the 4×4 example game, there are four choices of probability of winning for the players including 100% (first playing row), 75% (second playing row), 50% (third playing row) or 25% (fourth playing row).

FIG. 4 is an example 5×5 player game matrix which is constructed in accordance with an embodiment. In the 5×5 example game, there are five choices of probability of winning for the players including 100% (first playing row), 80% (second playing row), 60% (third playing row), 40% (fourth playing row) or 20% (fifth playing row).

FIG. 5 is an example 10×10 player game matrix which is constructed in accordance with an embodiment. In the 10×10 example game matrix, there are ten choices of probability of winning for the players including 100% (first playing row), 90% (second playing row), 80% (third playing row), 70% (fourth playing row), 60% (fifth playing row), 50% (sixth playing row), 40% (seventh playing row), 30% (eighth playing row), 20% (ninth playing row) or 10% (tenth playing row).

In the 10×10 game matrix, the maximum payout is 10 tokens as seen at the bottom row. Prior to game start, the player chooses one of the probabilities that the player would like to risk a token. This probability represents a percent of success in the game draw. In general terms, a higher probability and resulting chance of success correlates with a lower potential return. And relatedly, a lower probability of success correlates with a greater return or payout.

In this embodiment, a player is not allowed to choose the value of 100 from the second row because the game does not guarantee a 100% probability of winning. We could do this but in essence the player would just be getting their money back and at the expense of computational energy. However, a player may choose probabilities of 90%, 80%, 70%, etc. down to 10% in the example shown in FIG. 5. If the row is selected during the playing of the game, the player will win the non-zero amount that is depicted in that corresponding row of the game matrix. For example, if a player chooses a 60% probability of success, the player can win 1.66 tokens based on an initial bet of 1 token. Bets that are lost are represented by the "0"s in the game matrix.

In operation when the game is played, the game generates a random integer "R" from 1 to "P" in the game, where P=Number of players in the game and $1 \leq R \leq P$. The lottery game then does a matrix lookup based on the (X, Y) matrix position for the value of winning percentage and the number R. This value is either zero (0) or a non-zero number in the matrix position. If the value is zero (0), the player loses that bet. In the example (taken from FIG. 5) where the probability is 60% and R=5, the player will win 1.66 tokens. Therefore, the player's net result from the bet will be 0.66 tokens since the player had to pay one (1) token to enter the game. In an embodiment, the payout of 1.66 tokens to the player will be reduced by the amount of service fee that the game provider is charging for this game.

As shown in FIGS. 6A-6D, the process to create the example 10×10 matrix shown in FIG. 5 will be described.

In FIG. 6A, the first element in the second row (a number "1" in the far left hand column headed by a "1" in the top first row) is divided into the count of the remaining cells (columns) for the second row (columns headed by "2" thru "10" in the top first row). In this case, 1/9=0.11. For the next row, the first element is set to "0", and then 0.11 is added into each cell in increasing column order. Because each cell already contains a "1", adding "0.11" to each cell (i.e., 1+0.11) equals 1.11. Therefore, after this operation, there is a zero in the first column and 1.11 in all other columns (cells).

Next, the operation is repeated for the third row as shown in FIG. 6B. The second element in the second row (a number "1.11" in the second column headed by a "2" in the top first row) is divided into the count of the remaining cells (columns) for the second row (columns headed by "3" thru "10" in the top first row). Because each cell already contains a "1.11", adding 0.14 (1.11 divided by 8) to 1.11 equals 1.25. Therefore, after this operation, there is a zero in the first two columns and 1.25 in all other columns (cells).

Similarly, for the fourth row, the number 1.25 is divided by 7 to equal 0.18. Then, 0.18 is added to the 1.25 to equal 1.42.

As shown in FIG. 6D, increasing numerical values are generated into the matrix for the row and column matrix index values, which are also increasing. As a result, after the payout numbers are generated for the last row, the 10×10 matrix contains zeros in the lower left portion of the matrix and non-zero values in the upper right portion. Further, the winning probability of each row is the ratio of the number of cells containing a non-zero to the number of cells containing a zero.

In general, for P number of players, a P×P game matrix is created where $2 \leq P < \text{infinity}$ In an embodiment, the Java code below is provided regarding the construction of the probability matrix.

```
/**
 *
 * The method 'zeroEntry' is meant to zero (set to '0'), one element in
 * the numberList array and spread that number amongst the remaining
 entries.
 *
 * To do this, find the first non-zero entry in numberList, zero this and
 * spread that value over the remaining non-zero entries. We do this in
 * increasing array index order in the numberList array.
 *
```

-continued

```
* This also builds the matrix array if we call zeroEntry
'numberOfPlayers'
* times using the 'index' argument.
*
* @param index
*/
public void zeroEntry(int index) {
  float f = 0;
  float partial = 0;
  int nonZeroCount = 0;
  // The variable 'nonZeroCount' needs to be determined.
  // It will be used later below.
  for (int i = 0; i < numberOfPlayers; i++) {
    f = numberList[i];
    if (f != 0) {
      nonZeroCount++;
    }
  }
  if (nonZeroCount == 0) {
    return;
  }
  // Find the first non-zero entry, set it to zero and leave the loop.
  for (int i = 0; i < numberOfPlayers; i++) {
    f = numberList[i];
    if (f != 0) {
      numberList[i] = (float) 0;
      break;
    }
  }
  // Spread f amongst remaining entries.
  partial = f / (nonZeroCount - 1);
  float tmp = 0;
  for (int i = 0; i < numberOfPlayers; i++) {
    f = numberList[i];
    if (f != 0) {
      tmp = numberList[i] + partial;
      numberList[i] = tmp;
    }
  }
  // Now put numberList into matrix
  for (int i = 0; i < numberOfPlayers; i++) {
    matrix[index][i] = numberList[i];
  }
  // Assign probability array.
  probability[index - 1] = ((float) nonZeroCount /
  numberOfPlayers) * 100;
}
```

As shown FIG. 7, a flowchart is depicting the creation of a probability matrix as discussed above. After starting at step 702, the matrix is initialized to a row of "1"s and setting "J" equal to one (1). At step 704, J is then compared to the number of players. If J is equal to the number of players, then the matrix creation is concluded at step 708. If J is less than the number of players, then the left most column entry is set to a temporary variable, after which the left most column entry is set to zero (0), and finally the amount of the temporary variable is distributed evenly to the remaining columns with non-zero entries at step 710. The new row created at step 710 is added to the matrix at step 712. At step 714, J is increased by a value of one (1) and returns to step 706 to determine whether to create another row.

Figure 8:
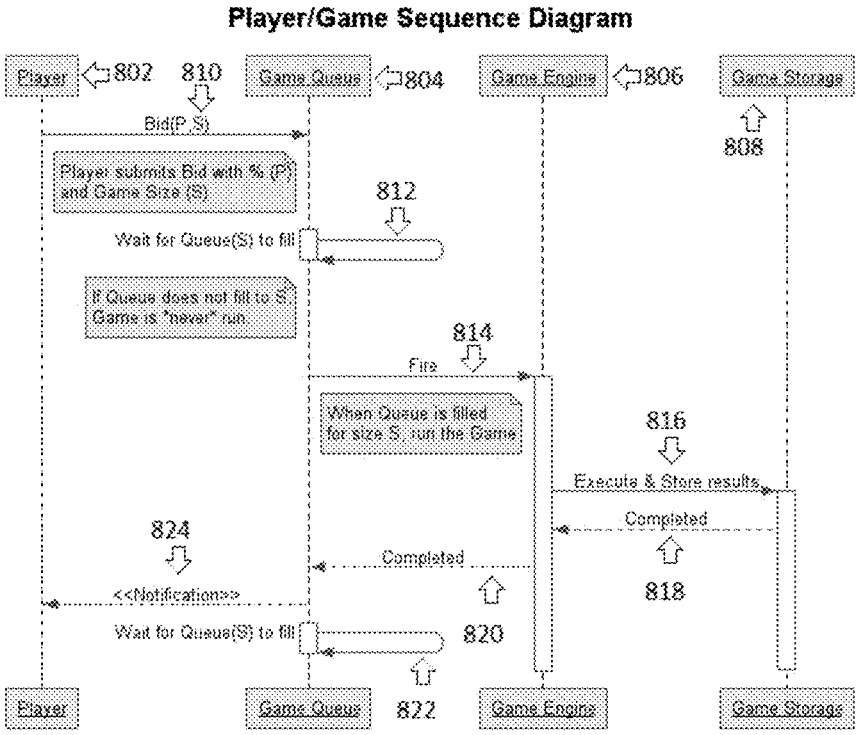
FIG. 8 shows a diagram depicting the sequence of events that occurs when a game is initiated by a player.

In FIG. 8, a diagram is shown depicting the sequence of events that occurs when a game is initiated by a player. Beginning as a Player at step 802, a player submits a game bid for a certain winning probability P % and game size (S) at step 810. At the Game Queue step 804, the player waits for the Queue to fill up for that particular size Game S. If this never occurs, the Game is not run. When the Game is filled to size S, the Game is run at step 814 via the Game Engine 806. Once the Game is run, the Game Storage 808 stores the results at step 816. Notifications are provided at step 818, step 820 and step 824.

In an embodiment, the lottery game matrix may allow for draws to occur at any time during a 24-hour cycle and is not predefined. This is unlike conventional lotteries which have preset drawing times. The draw times for the lottery of the present invention are a function of runtime demand and the size of the game (i.e., the player queue size, S) that the player wants to participate in. When a player signs up for a game, the player specifies the maximum amount of money they want to win, which correlates to the total number of players in the game. The player queue size is represented by the following function:

$$2 \leq \text{Queue Size} < \text{infinity}$$

$$T(\text{draw}) = f(\text{QS}),$$

where T is the time of the draw, and

QS represents both the player Queue Size and the maximum amount of money that can be won in the draw.

The game draw for any N×N game is executed when the queue for that game fills up with players. Games are played on a first come first serve basis. Thus, there are no timing guarantees when a game queue will fill up and is strictly a function based on player demand. When a game is played, that queue is emptied and reset to zero (0) for the number of players. Multiple games of the same queue size, or of different queue sizes, may be played simultaneously.

In typical operation, a queue of 10 will most likely fill up with players before a queue of 1,000,000 players fills up. Because of the timing, win probability and payout amounts are a function of the game size, this leads to various strategies for players. For example, in a game of queue size 10, 10 tokens are the maximum amount of tokens that a player can win. In contrast, for a game of queue size one (1) Million, one (1) Million tokens is the maximum amount of tokens that a player can win. In comparison, a player may win smaller amounts from the game with a queue size of 10, but the frequency of play may make up for smaller amounts won.

Figure 9:
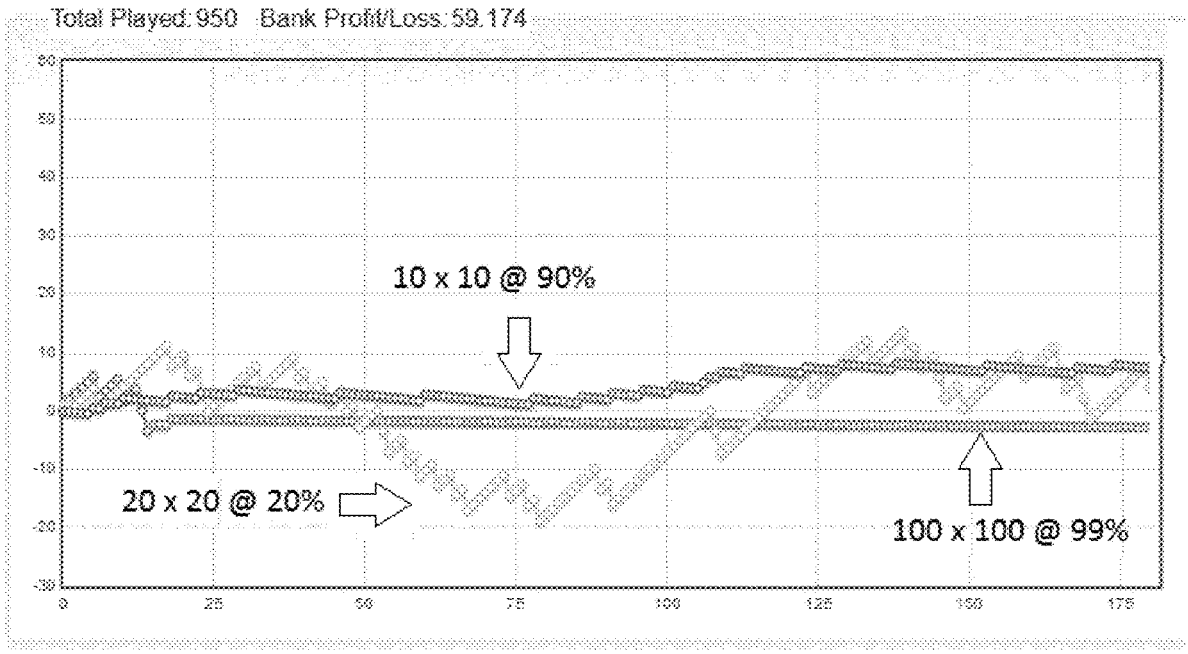
FIG. 9 shows a computer run with 333 users running a 10×10 matrix (Risk Class 10) @ Risk Level 90%, 333 users running a 20×20 matrix @ Risk Level 20% and 333 users running a 100×100 matrix @ Risk Level 99%. The service fee in this simulation was 10%.

As shown in FIG. 9, a computer simulated run graphs 333 participants playing in each of the following Risk Classes: 10×10 @ 90%, 20×20 @ 20%, and 100×100 @ 99%. In an embodiment, the fees charged to the players by the provider include fees that the provider pays for access to the gaming system network, such as access to blockchain related systems. For this simulation, the provider was able to make a profit of 59.174 tokens.

As shown by the simulation, the present invention may give gamblers actual wins in small, sustainable amounts with the option to select healthy amounts of risk. For example, players may select a 90% probability of payout (with a corresponding lower payout for the lower risk). Therefore, the invention may help problem gamblers reduce their playing of high-risk games that invoke "near miss" cognitive mechanisms and encourage subsequent problem gambling symptoms.

Some embodiments have been described in terms of a client-server interaction to facilitate game play. In other embodiments, a game may be offered though a cloud based gaming environment. In such an embodiment, one cloud component may offer location services, another may offer accounting serves, another may offer random number generation services, and another may offer login services. An embodiment in such an environment may use these services to provide gaming functionality to users.

For example, a gaming service may connect to a gaming cloud through which a user accesses gaming services. The gaming service may make a game available to users through the gaming cloud. User account information, monetary information, location information, and so on may be maintained by other cloud services for the gaming service.

Numerous embodiments are described in the present application, and are presented for illustrative purposes only. The described embodiments are not, and are not intended to be, limiting in any sense. The presently disclosed invention (s) are widely applicable to numerous embodiments, as is readily apparent from the disclosure. One of ordinary skill in the art will recognize that the disclosed invention(s) may be practiced with various modifications and alterations, such as structural, logical, software and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

Though an embodiment may be disclosed as including several features, other embodiments of the invention may include fewer than all such features. Thus, for example, a claim may be directed to less than the entire set of features in a disclosed embodiment, and such claim would not include features beyond those features that the claim expressly recites.

No embodiment of method steps or product elements described in the present application constitutes the invention claimed herein, or is essential to the invention claimed herein, or is coextensive with the invention claimed herein, except where it is either expressly stated to be so in this specification or expressly recited in a claim.

It will be readily apparent to one of ordinary skill in the art that the various processes described herein may be implemented by, e.g., appropriately programmed general purpose computers, special purpose computers and computing devices.

Typically a processor (e.g., one or more microprocessors, one or more microcontrollers, one or more digital signal processors) will receive instructions (e.g., from a memory or like device), and execute those instructions, thereby performing one or more processes defined by those instructions. Instructions may be embodied in, e.g., one or more computer programs, one or more scripts.

A "processor" means one or more microprocessors, central processing units (CPUs), computing devices, microcontrollers, digital signal processors, or like devices or any combination thereof, regardless of the architecture (e.g., chip-level multiprocessing/multi-core, RISC, CISC, Microprocessor without Interlocked Pipeline Stages, pipelining configuration, simultaneous multithreading).

Thus a description of a process is likewise a description of an apparatus for performing the process. The apparatus that performs the process can include, e.g., a processor and those input devices and output devices that are appropriate to perform the process.

Further, programs that implement such methods (as well as other types of data) may be stored and transmitted using a variety of media (e.g., computer readable media) in a number of manners. In some embodiments, hard-wired circuitry or custom hardware may be used in place of, or in combination with, some or all of the software instructions that can implement the processes of various embodiments. Thus, various combinations of hardware and software may be used instead of software only.

The term "computer-readable medium" refers to any medium, a plurality of the same, or a combination of different media that participate in providing data (e.g., instructions, data structures) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory.

Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying data (e.g. sequences of instructions) to a processor. For example, data may be (i) delivered from RAM to a processor; (ii) carried over a wireless transmission medium; (iii) formatted and/or transmitted according to numerous formats, standards or protocols, such as Ethernet (or IEEE 802.3), SAP, ATP, Bluetooth, and TCP/IP, TDMA, CDMA, and 3G; and/or (iv) encrypted to ensure privacy or prevent fraud in any of a variety of ways well known in the art.

Thus a description of a process is likewise a description of a computer-readable medium storing a program for performing the process. The computer-readable medium can store (in any appropriate format) those program elements which are appropriate to perform the method.

Various embodiments can be configured to work in a network environment including a computer that is in communication (e.g., via a communications network) with one or more devices. The computer may communicate with the devices directly or indirectly, via any wired or wireless medium (e.g. the Internet, LAN, WAN or Ethernet, Token Ring, a telephone line, a cable line, a radio channel, an optical communications line, commercial on-line service providers, bulletin board systems, a satellite communications link, and a combination of any of the above). Each of the devices may themselves comprise computers or other computing devices, such as those based on the Intel Pentium, Centrino™, or Intel Core processors, that are adapted to communicate with the computer. Any number and type of devices may be in communication with the computer.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a process is described, in an embodiment the process may operate without any user intervention. In another embodiment, the process may include some human intervention (e.g., a step is performed by or with the assistance of a human).

Although the invention has been described with reference to the above examples, it will be understood that many modifications and variations are contemplated within the true spirit and scope of the embodiments of the invention as disclosed herein. Many modifications and other embodiments of the invention set forth herein will come to mind to one skilled in the art to which the invention pertains having the benefit of the teachings presented in the foregoing descriptions and the associated drawings. Therefore, it is to be understood that the invention shall not be limited to the specific embodiments disclosed and that modifications and other embodiments are intended and contemplated to be included within the scope of the appended claims. Although specific terms are employed herein, they are used in a generic and descriptive sense only and not for purposes of limitation.

Figure 10:
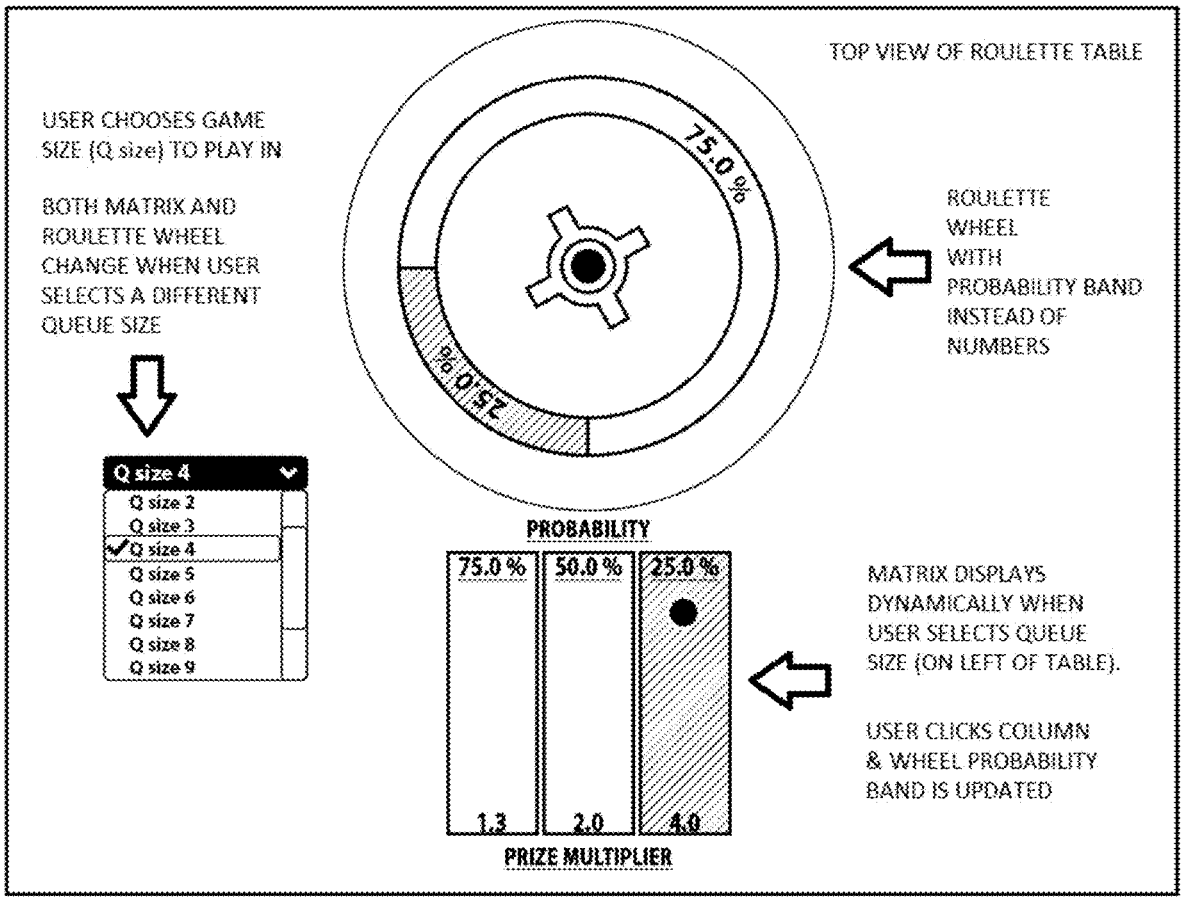
Figure 11:
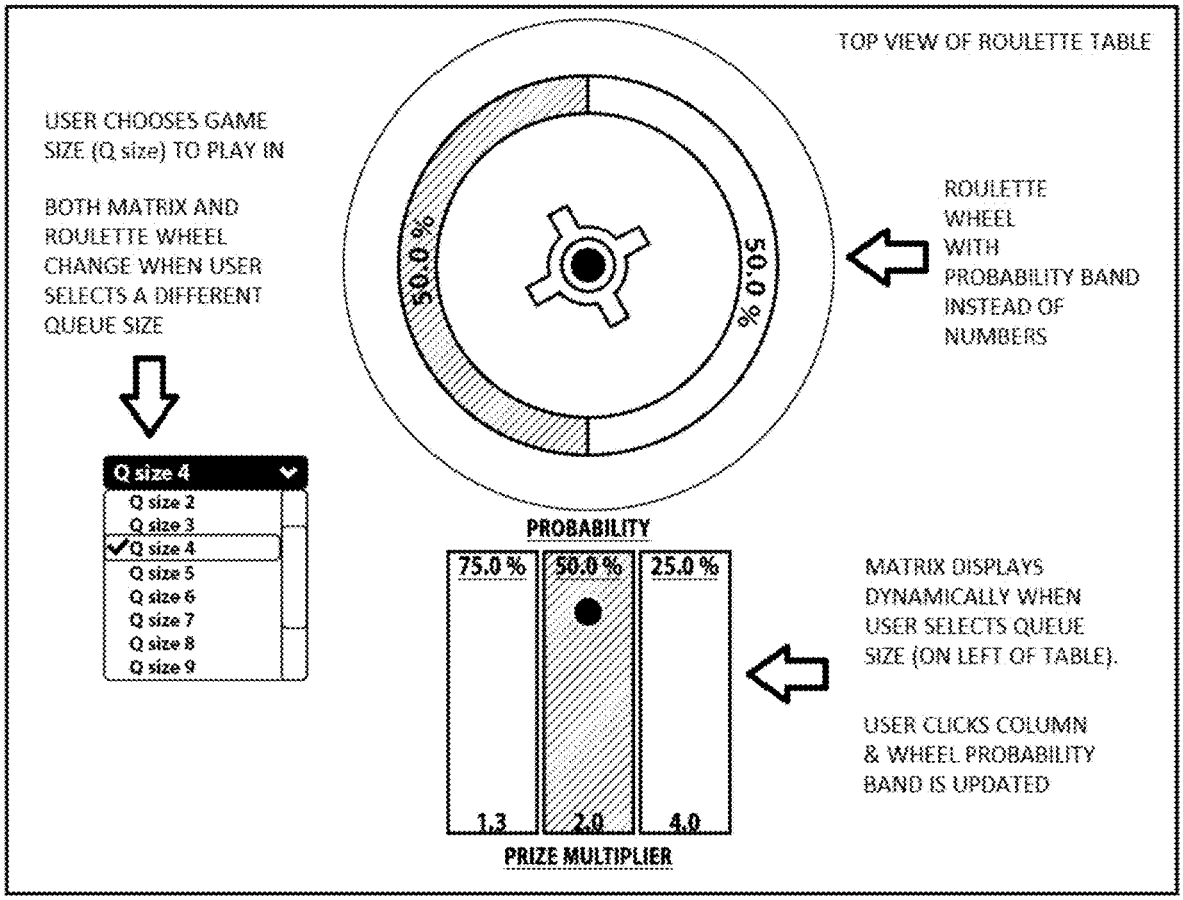
Figure 12:
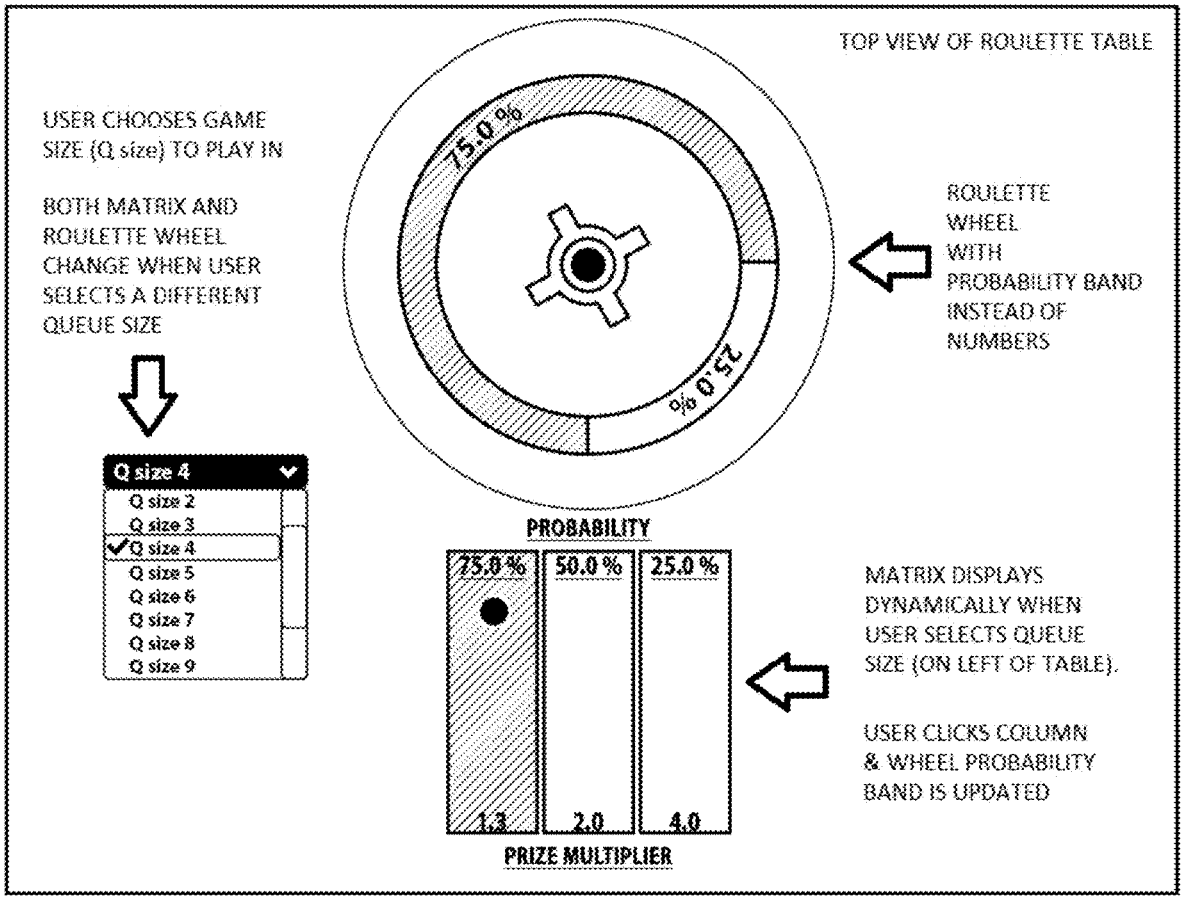

In the current embodiment we implement this strategy to the well-known game of Roulette and transform this game into a completely new game. We map the investment matrix onto a standard American or European Roulette table in two ways described here and shown in FIGS. 10, 11 and 12.

We replace the standard numerical colored grid of the roulette table with the investor matrix.

We replace the numbered roulette wheel with a dynamically generated probability colored band derived from the matrix row that the user selects on the table surface. The row's 0's are mapped to the white band in the diagrams. The row's non-0 numbers are mapped to the dark band in the diagrams. Hence the roulette wheel has been replaced by a continuously connected dark and white band which represents the respective probabilities of winning and losing in a roulette spin for the selected table row.

This allows the user to visual the probabilities of winning and losing as they position bets on the table.

This visualization transformation technique can be applied to any game of chance if game state can be described by a probability matrix.

What is claimed is:

1. A non-transitory computer-readable medium having computer instructions stored thereon, which when executed by a processor, causes the processor to perform the steps of:

displaying, by a graphical user interface, a game layout for a game, the game layout including a roulette wheel region, a probability region, and a matrix selection region;

enabling a player of the game to select, by an input device interacting with the matrix selection region associated with the game layout displayed by the graphical user interface, a matrix from a plurality of different matrices, wherein each matrix of the plurality of different matrices includes a different quantity of cells, wherein each cell represents a probability of winning the game, wherein a first matrix of the plurality of different matrices having a first size includes a first quantity of cells and a second matrix of the plurality of different matrices having a second size, greater than the first size, includes a second quantity of cells, the second quantity of cells greater than the first quantity of cells;

displaying, in the probability region of the graphical user interface, a probability table configured to be dynamically adjustable to include a quantity of columns equal to the quantity of cells of the matrix selected by the player of the game, wherein each column of the probability table corresponds to each probability represented by each cell of the selected matrix;

enabling a player, via the input device interacting with the probability region of the graphical user interface, to perform a bet placement action, wherein the bet placement action places a monetary bet on a particular column of the probability table after being dynamically adjusted based on selection of a matrix by the player, the placement of monetary bet corresponding to player-selected final probability for winning the game;

displaying, in the roulette wheel region of the graphical user interface, a dynamically adjustable roulette wheel having only a first segment and a second segment, wherein the first segment is inversely proportional to the player-selected final probability for winning the game, and wherein a size of the first segment and the second segment dynamically changes based on the player-selected final probability for winning the game to either increase the size of the first segment and decrease the size of the second segment, or decrease the size of the first segment and increase the size of the second segment, as the player interacts with the probability table;

rotating, in the roulette wheel region of the graphical user interface, the dynamically adjustable roulette wheel after placement of the monetary bet, the roulette wheel including a moveable indicator that is configured to move about the wheel and come to rest to randomly identify either the first segment or the second segment of the wheel, wherein a random number generator is utilized to randomly identify which segment is selected by the movable indicator;

determining if the player has won the game by determining if the movable indicator randomly selected the first segment of the roulette wheel; and in response to determining the player has won the game, resolving the monetary bet by multiplying the monetary bet by a value associated with the player-selected final probability.

2. A non-transitory computer-readable medium having computer instructions stored thereon, which when executed by a processor, causes the processor to perform the steps of:

displaying, by a graphical user interface, a game layout for a game, the game layout including a game outcome region, a probability region, and a matrix selection region;

enabling a player of the game to select, by an input device interacting with the matrix selection region associated with the game layout displayed by the graphical user interface, a matrix from a plurality of different matrices, wherein each matrix of the plurality of different matrices includes a different quantity of cells, wherein each cell represents a probability of winning the game, wherein a first matrix of the plurality of different matrices having a first size includes a first quantity of cells and a second matrix of the plurality of different matrices having a second size, greater than the first size, includes a second quantity of cells, the second quantity of cells greater than the first quantity of cells;

displaying, in the probability region of the graphical user interface, a probability table configured to be dynamically adjustable to include a quantity of columns equal to the quantity of cells of the matrix selected by the player of the game, wherein each column of the probability table corresponds to each probability represented by each cell of the selected matrix;

enabling a player, via the input device interacting with the probability region of the graphical user interface, to perform a bet placement action, wherein the bet placement action places a monetary bet on a particular column of the probability table after being dynamically adjusted based on selection of a matrix by the player, the placement of monetary bet corresponding to player-selected final probability for winning the game;

displaying, in the game outcome region of the graphical user interface, a dynamically adjustable win/loss indicator having a win area and a loss area, wherein a size of the win area and a size of the loss area dynamically changes based on the player-selected final probability for winning the game to either increase the size of the win area and decrease the size loss area, or decrease the size of the win area and increase the size of the loss area;

randomly selecting, by a random number generator, either the win area or the loss area as an outcome for the game after placement of the monetary bet;

determining if the player has won the game in response to the win area being selected as the outcome of the game; and in response to determining the player has won the game, resolving the monetary bet by multiplying the monetary bet by a value associated with the player-selected final probability.

* * * * *